US011583721B2

(12) United States Patent
Chen

(10) Patent No.: US 11,583,721 B2
(45) Date of Patent: Feb. 21, 2023

(54) DUMBBELL AND BARBELL SUPPORTING SYSTEM

(71) Applicant: Floriey Industries International Co., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 60 days.

(21) Appl. No.: 17/376,381

(22) Filed: Jul. 15, 2021

(65) Prior Publication Data

US 2023/0016579 A1 Jan. 19, 2023

(51) Int. Cl.

*A63B 21/078* (2006.01)
*A63B 21/072* (2006.01)
*A63B 21/075* (2006.01)

(52) U.S. Cl.

CPC ..... *A63B 21/078* (2013.01); *A63B 21/075* (2013.01); *A63B 21/0724* (2013.01); *A63B 21/0726* (2013.01); *A63B 21/0728* (2013.01); *A63B 2225/105* (2013.01)

(58) Field of Classification Search

CPC ..... A63B 21/072; A63B 21/0722; A63B 21/0724; A63B 21/0726; A63B 21/0728; A63B 21/075; A63B 21/078; A63B 2225/105

See application file for complete search history.

(56) References Cited

U.S. PATENT DOCUMENTS

| | | | | |
|---|---|---|---|---|
| 7,022,053 | B2 | 4/2006 | Whetstone | |
| 7,201,711 | B2 | 4/2007 | Towley, III et al. | |
| 7,491,156 | B1 | 2/2009 | GaoYong | |
| 8,047,971 | B2 | 11/2011 | Parker | |
| 8,444,537 | B1 | 5/2013 | Santoro | |
| 8,992,395 | B2 | 3/2015 | Orakwusi | |
| 9,717,943 | B2 | 8/2017 | Klonoski | |
| 9,956,451 | B1 | 5/2018 | Wang | |
| 10,328,299 | B2 | 6/2019 | Wang | |
| 11,103,739 | B2 * | 8/2021 | Shaw, Jr. | A63B 23/12 |
| 11,207,557 | B2 * | 12/2021 | Chen | A63B 21/0722 |
| 11,260,270 | B1 * | 3/2022 | Owusu | A63B 71/0036 |
| 11,273,338 | B2 * | 3/2022 | Chen | A63B 71/0036 |
| 2018/0178051 | A1 * | 6/2018 | Shaw, Jr. | A63B 21/078 |
| 2020/0306578 | A1 * | 10/2020 | Pohl | A63B 21/078 |

* cited by examiner

*Primary Examiner* — Loan B Jimenez
*Assistant Examiner* — Kathleen M Fisk
(74) *Attorney, Agent, or Firm* — Browdy and Neimark, PLLC

(57) ABSTRACT

A dumbbell and barbell supporting system includes two tables movable toward and away from each other and each having a plate, a casing and a bracket disposed on each of the plates and the bracket being movable and rotatable relative to the casing, two dumbbells disposed on the tables and each including two weight members and two weight elements disposed on the bracket and the casing, and two handlebars engageable with the weight members and the weight elements, the weigh members are movable toward each other, and the weight elements also movable toward each other, and a longitudinal bar is engageable with the weight members and the weight elements for acting as a barbell device.

12 Claims, 11 Drawing Sheets

DUMBBELL AND BARBELL SUPPORTING SYSTEM

BACKGROUND OF THE INVENTION

1. Field of the Invention

The present invention relates to an exercise device supporting system, and more particularly to a dumbbell and barbell supporting system including an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

2. Description of the Prior Art

Various kinds of typical adjustable exercise devices, such as dumbbells have been developed and provided for conducting various exercise operations, and various kinds of typical supporting devices have been developed and provided for supporting various exercise devices, such as the adjustable dumbbells, the barbell devices or the like.

For example, U.S. Pat. No. 7,022,053 B2 to Whetstone, U.S. Pat. No. 7,201,711 B2 to Towley, III et al., U.S. Pat. No. 7,491,156 to GaoYong, U.S. Pat. No. 8,047,971 B2 to Parker, U.S. Pat. No. 8,444,537 B1 to Santoro, U.S. Pat. No. 8,992,395 to Orakwusi, U.S. Pat. No. 9,717,943 B2 to Klonoski, U.S. Pat. No. 9,956,451 B1 to Wang, and U.S. Pat. No. 10,328,299 B2 to Wang disclose several of the typical exercise device supporting structures or configurations for supporting adjustable dumbbell devices or the like.

However, the typical exercise device supporting structures or configurations may only be provided for supporting the dumbbell devices, but failed to teach and provide an exercise device supporting system for supporting one or more dumbbell devices and for allowing the dumbbell devices to be easily and quickly adjusted or converted to a barbell device.

The present invention has arisen to mitigate and/or obviate the afore-described disadvantages of the conventional exercise device supporting structures.

SUMMARY OF THE INVENTION

The primary objective of the present invention is to provide a dumbbell and barbell supporting system including an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

In accordance with one aspect of the invention, there is provided a dumbbell and barbell supporting system comprising a first table including a first plate, a first casing disposed on the first plate, a first bracket disposed on the first plate and slidable toward and away from the first casing, and rotatable relative to the first plate and the first casing and the first table, a second table including a second plate, the second table being movable toward and away from the first table, a second casing disposed on the second plate, a second bracket disposed on the second plate and slidable toward and away from the second casing, and rotatable relative to the second plate and the second casing and the second table, a first dumbbell disposed on the first table, the first dumbbell including a first weight member disposed on the first bracket, and a second weight member disposed on the first casing, and a first handlebar engageable with the first weight member and the second weight member for detachably coupling the first weight member and the second weight member to the first handlebar, a second dumbbell disposed on the second table, the second dumbbell including a first weight element disposed on the second bracket, and a second weight element disposed on the second casing, and a second handlebar engageable with the first weight element and the second weight element for detachably coupling the first weight element and the second weight element to the second handlebar, the first weight member and the first bracket being movable toward and rotatable relative to the second weight member and the first casing, and being disposed beside the second weight member when the first weight member and the first bracket are moved toward the second weight member and the first casing and rotated relative to the second weight member and the first casing, the first weight element and the second bracket being movable toward and rotatable relative to the second weight element and the second casing, and being disposed beside the second weight element when the first weight element and the second bracket are moved toward the second weight element and the second casing and rotated relative to the second weight element and the second casing, and a longitudinal bar engageable with the first weight member and the first weight element for detachably coupling the first weight member and the second weight member and the first weight element and the second weight element to the longitudinal bar and for acting as a barbell device, and arranged for allowing the dumbbell devices and the barbell device to be easily and quickly adjusted or converted to each other when required.

The first and the second tables each include a groove formed in the first and the second plates, and the first and the second brackets each include a pivot spindle engaged with the groove of the first and the second plate for guiding and limiting the first and the second brackets to slide and move and to rotate relative to the first and the second plates, and arranged for allowing the first and the second brackets to be pivoted and rotated relative to the first and the second plates respectively.

A first rod may further be provided and engaged between the first and the second tables for guiding and limiting the first and the second tables to slide and move relative to each other. The first and the second tables each include at least one roller engaged with the first rod for guiding the first rod to slide and move relative to the first and the second tables, and also for guiding the first and the second tables to slide and move relative to each other.

The first and the second tables each include a channel formed in the first and the second plates, and the first rod includes two studs engaged in the channels of the first and the second plates for guiding and limiting the first and the second tables to slide and move relative to each other. The first and the second tables each include a notch formed in the first and the second plates and communicating with the channels of the first and the second plates respectively for engaging with the studs.

The first rod includes a knob for rotating the first rod relative to the first and the second tables and for disengaging and engaging the studs with the notches of the first and the second plates. A second rod may further be provided and engaged between the first and the second tables for guiding and limiting the first and the second tables to slide and move relative to each other.

The first and the second tables each include at least one roller engaged with the second rod for guiding the second rod to slide and move relative to the first and the second tables. The second rod includes a tube coupled to the first rod. The tube includes a barrel for receiving and engaging with the first rod. The barrel includes a slot, and the knob is engaged in the slot of the barrel for limiting and guiding the first rod to rotate relative to the barrel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
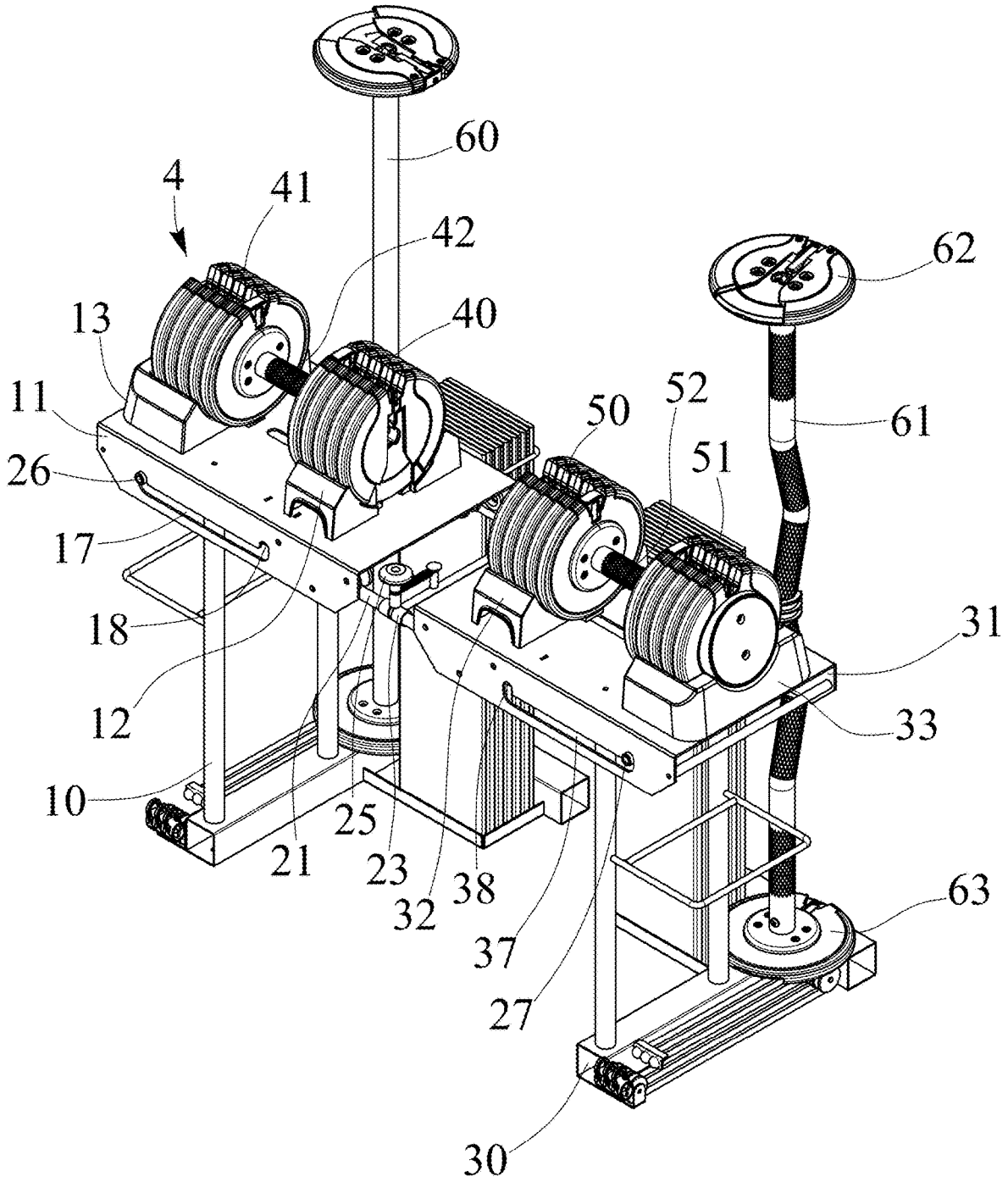
FIG. 1 is an upper perspective view of a dumbbell and barbell supporting system in accordance with the present invention as seen from the front portion of the dumbbell and barbell supporting system.

Referring to the drawings, and initially to FIGS. 1-7, a dumbbell and barbell supporting system in accordance with the present invention comprises a supporting base 1 including two tables 10, 30, such as a first and a second tables 10, 30 movable or adjustable toward or away from each other, each table 10, 30 include a supporting platform or plate 11, 31 formed or provided on top thereof, and two dumbbell exercise devices, such as a first and a second adjustable dumbbells 4, 5 are detachably or changeably or removably provided or disposed or supported on the first and the second plates 11, 31 of the tables 10, 30 respectively for allowing the dumbbells 4, 5 to be moved or adjusted toward or away from each other together with the tables 10, 30 respectively when the tables 10, 30 are moved or adjusted toward or away from each other.

The first and the second tables 10, 30 each include a bracket 12, 32 and a casing 13, 33 provided and attached or mounted or secured on the respective plate 11, 31 for engaging with and for supporting the first and the second dumbbells 4, 5 on the tables 10, 30 respectively. For example, the first dumbbell 4 includes two sets of weight rings or plates or members 40, 41, such as a first set and a second set of weight members 40, 41, and the second dumbbell 5 includes two sets of weight rings or plates or elements 50, 51, such as a first set and a second set of weight elements 50, 51, and the dumbbells 4, 5 each include a first or a second handlebar 42, 52 to be disposed or engaged between or with the weight members 40, 41 and the weight elements 50, 51 for forming or acting as the dumbbells 4, 5. The above-described structure or configuration for the dumbbells 4, 5 is typical and will not be described in specific details. The brackets 12, 32 and the casings 13, 33 are provided for engaging with and for supporting the sets of weight members 40, 41 and the weight elements 50, 51 of the dumbbells 4, 5 respectively.

The casings 13, 33 may be firmly or solidly and stably attached or mounted or secured on the tables 10, 30 with welders or adhesive materials or the like, or with screws or bolts or catches or latches or fasteners (not illustrated) or the like, and the brackets 12, 32 are slidably or detachably or changeably or removably and/or adjustably or pivotally attached or mounted or secured to the tables 10, 30 for suitably supporting the sets of weight members 40, 41 and the weight elements 50, 51 of the dumbbells 4, 5 on the tables 10, 30 respectively, for example, the tables 10, 30 each include an oblong hole or groove 14, 34 formed or provided in the plate 11, 31, and the brackets 12, 32 each include a pivot axle or shaft or spindle 14, 34 extended downwardly therefrom and engaged with the groove 14, 34 of the plate 11, 31 respectively for allowing the brackets 12, 32 to be slid and moved relative to the plates 11, 31 of the tables 10, 30 and toward or away from the casings 13, 33 respectively, and thus for allowing the weight members 40 and the weight elements 50 that are supported on the brackets 12, 32 to be pivoted or rotated relative to the tables 10, 30 and the other weight members 41 and the weight elements 51 for about one hundred and eighty (180) degrees.

It is preferable that the table 10, 30 each include one or more wheels or rollers 16, 36 (FIGS. 4, 6) formed or provided in the plates 11, 31, and one or more (such as two) elongated or longitudinal bars or columns or rods 20, 21 are engaged with the rollers 16, 36 of the plates 11, 31 and/or of the tables 10, 30 for guiding and limiting the tables 10, 30 to slide and move relative to each other, and toward or away from each other. It is preferable that a tube 22 is attached or coupled between or with the rods 20, 21 for allowing the rods 20, 21 to be slid and moved together with each other, for example, the tube 22 is firmly or solidly and stably attached or mounted or secured to one of the rods 20 with welders or adhesive materials or the like, or extended from one of the rods 20, and a sleeve or barrel 23 is formed or provided on one end portion the tube 22 for slidably receiving or engaging with the other rod 21 and arranged for allowing the rod 21 to be pivoted or rotated relative to the barrel 23.

For example, the barrel 23 includes a slot 24 formed therein (FIGS. 5, 6), and a handgrip or knob 25 is attached or mounted or secured to the rod 21 and slidably received or engaged in the slot 24 of the barrel 23 for limiting and guiding the rod 21 to pivot or rotate relative to the barrel 23 and the other rod 20. The tables 10, 30 each include a groove or channel 17, 37 formed or provided in the plate 11, 31 and one or more (such as two) recesses or notches 18, 38 formed therein and communicating with the channel 17, 37 of the plate 11, 31 respectively, and the rod 21 includes two projections or studs 26, 27 extended therefrom and slidably received or engaged in the channel 17, 37 of the plates 11, 31 or of the tables 10, 30 for further guiding and limiting the tables 10, 30 to slide and move relative to each other, and toward or away from each other, and the studs 26, 27 are engageable with either of the notches 18, 38 of the plates 11, 31 or of the tables 10, 30 for anchoring or retaining or locking or positioning the tables 10, 30 at a first position where the tables 10, 30 are located close to each other (FIGS. 1-4) and a second position where the tables 10, 30 are located farther away from each other (FIGS. 9 and 11).

Figure 2:
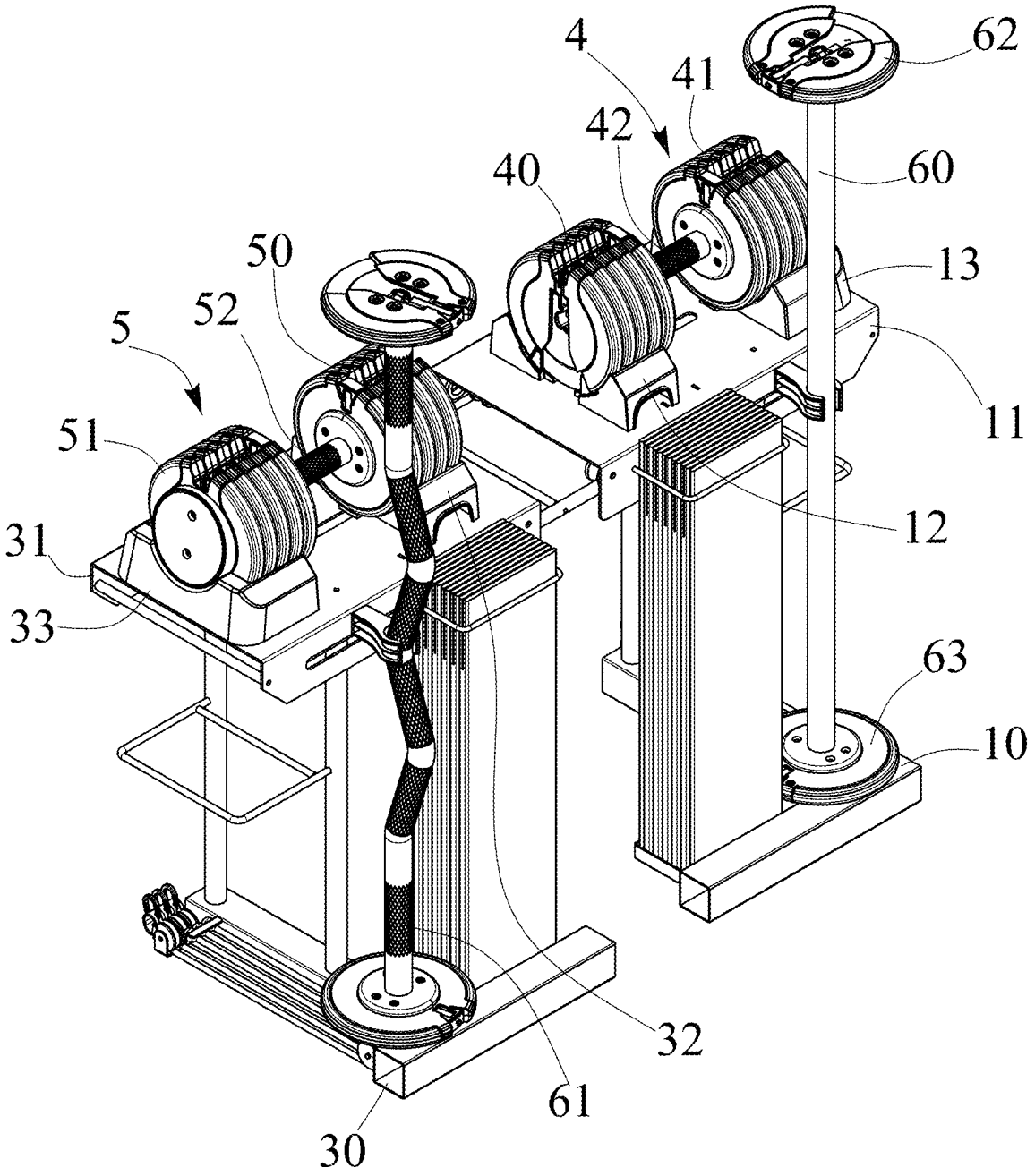
FIG. 2 is another upper perspective view of the dumbbell and barbell supporting system as seen from the rear portion of the dumbbell and barbell supporting system.
Figure 3:
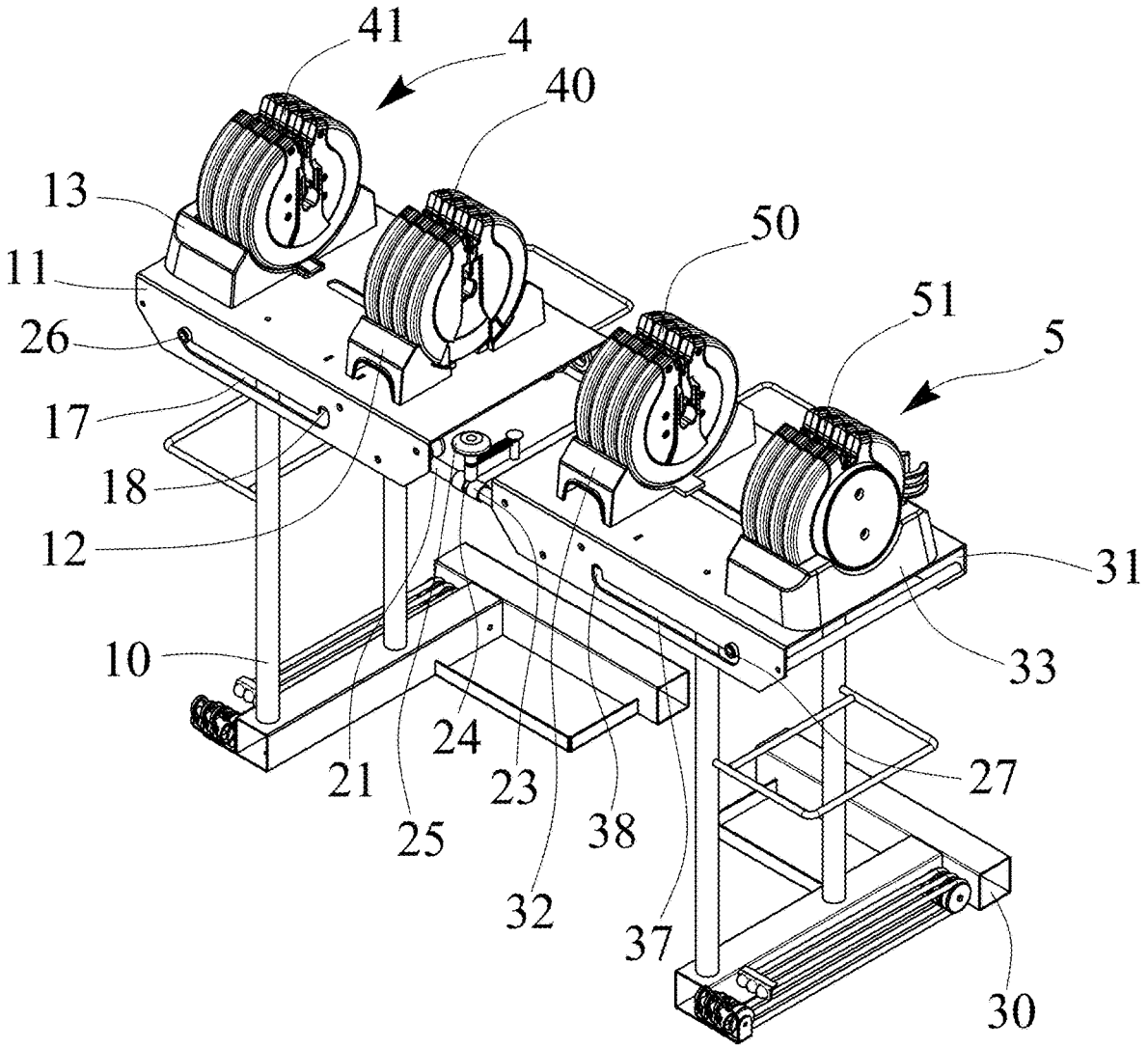
FIG. 3 is a further upper perspective view similar to FIG. 1, with bars and elements removed, illustrating the operation of the dumbbell and barbell supporting system.
Figure 4:
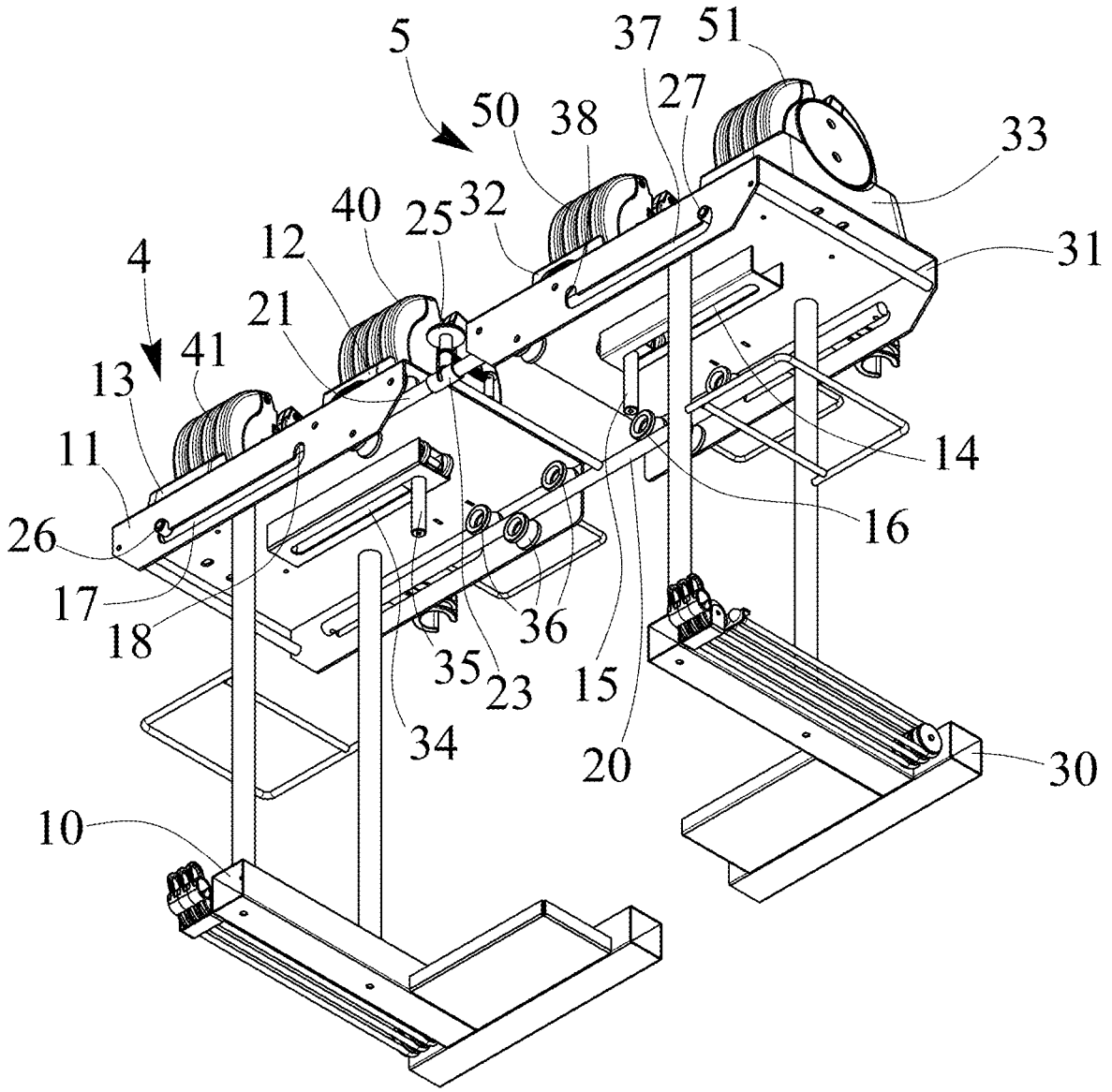
FIG. 4 is a bottom perspective view of the dumbbell and barbell supporting system
Figure 5:
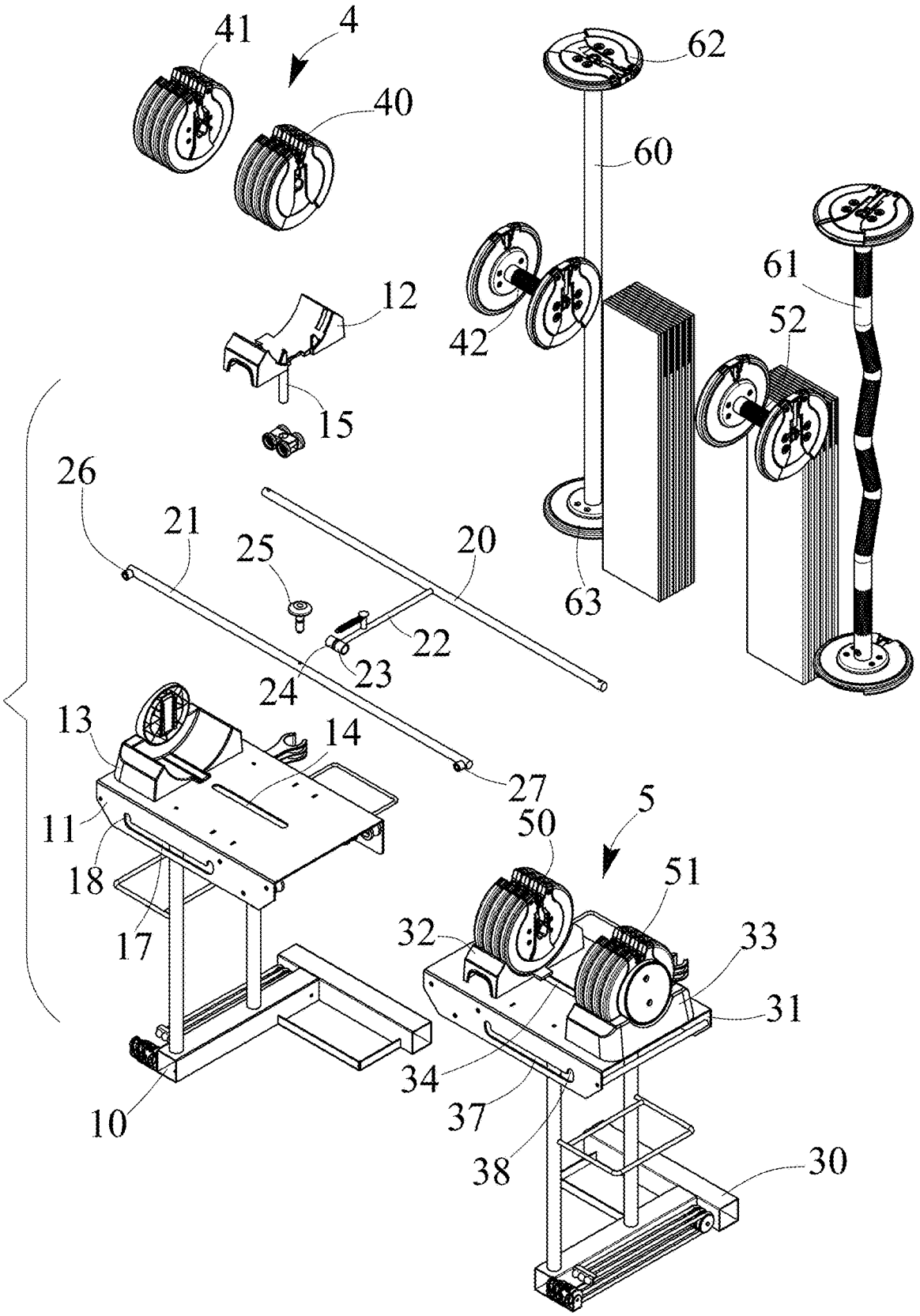
FIG. 5 is a partial exploded view as seen from the upper portion of the dumbbell and barbell supporting system.
Figure 6:
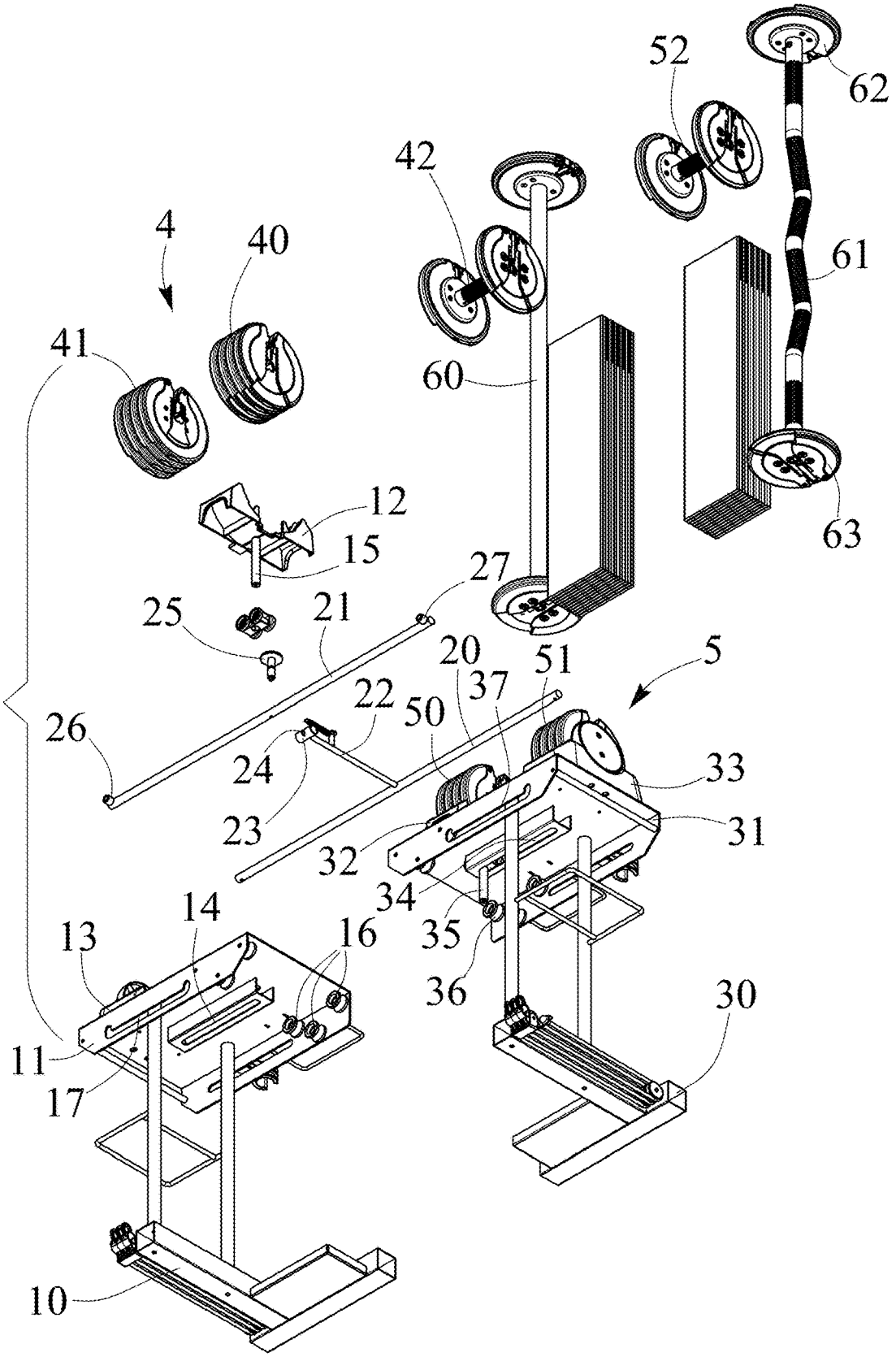
FIG. 6 is another partial exploded view as seen from the bottom portion of the dumbbell and barbell supporting system.
Figure 7:
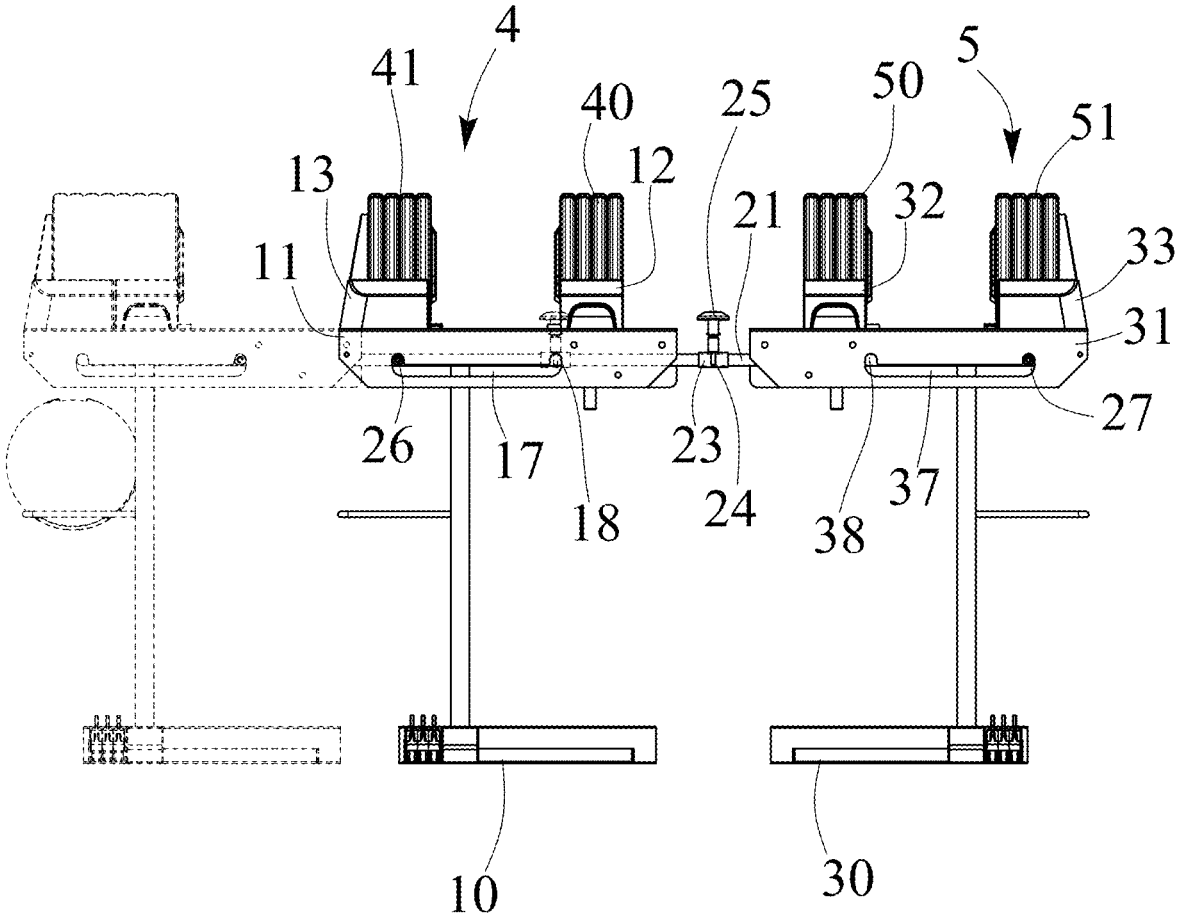
FIG. 7 is a partial front plan schematic view illustrating the operation of the dumbbell and barbell supporting system.
Figure 8:
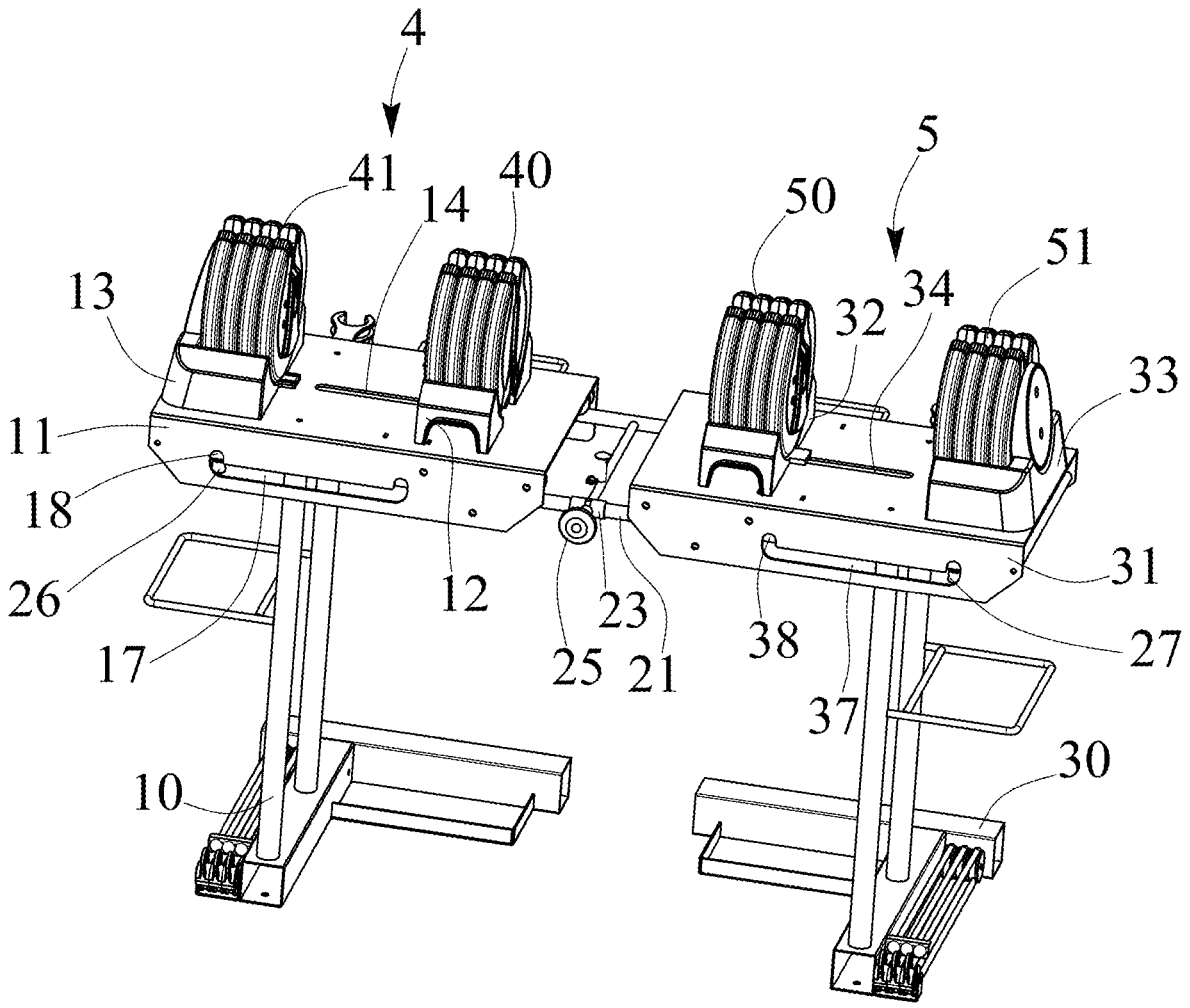
FIGS. 8, 9, 10 and 11 are other partial front plan schematic views illustrating the operation of the dumbbell and barbell supporting system.

In operation, as shown in FIGS. 1 and 2, the dumbbells 4, 5 are disposed or supported on the tables 10, 30 which are arranged for allowing the handlebars 42, 52 of the dumbbells 4, 5 to be easily and quickly held or grasped and actuated or operated by the users selectively. At this moment, the tables 10, 30 are moved toward each other, and the studs 26, 27 of the rod 21 may be engaged with one of the notches 18, 38 of the plates 11, 31 or of the tables 10, 30 for anchoring or retaining or locking or positioning the tables 10, 30 at the first position where the tables 10, 30 are located close to each other.

Figure 9:
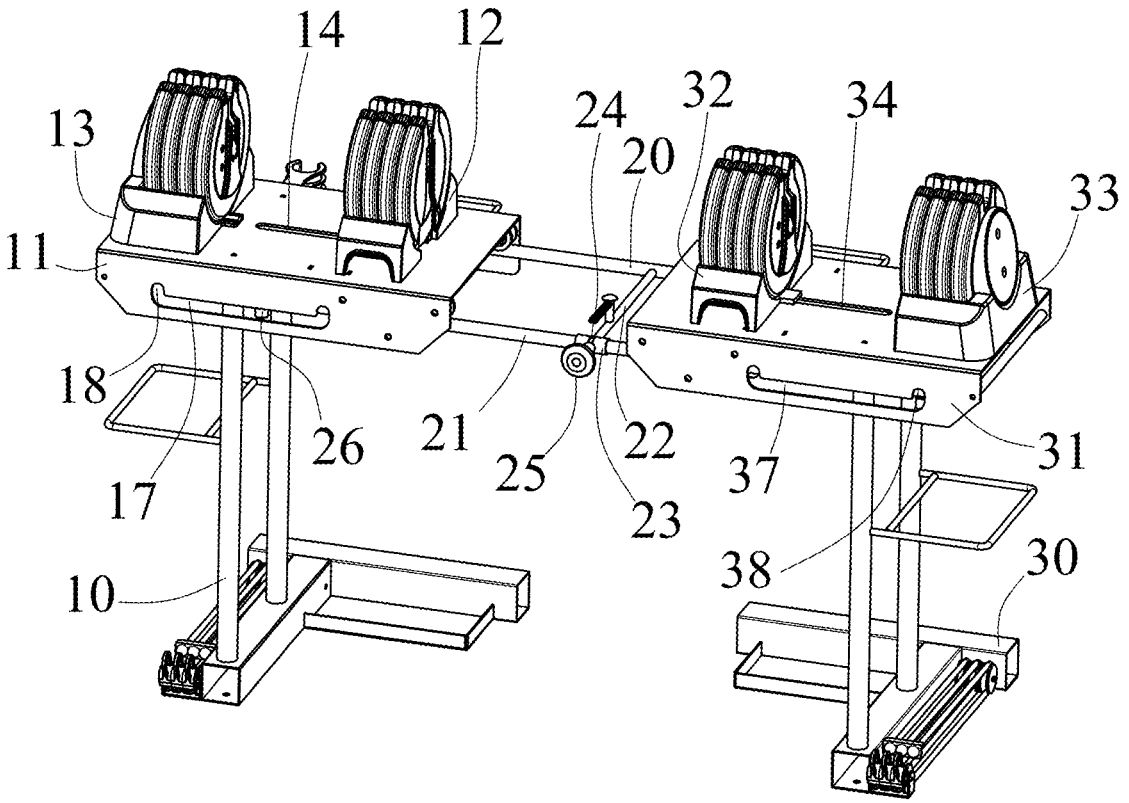
Figure 10:
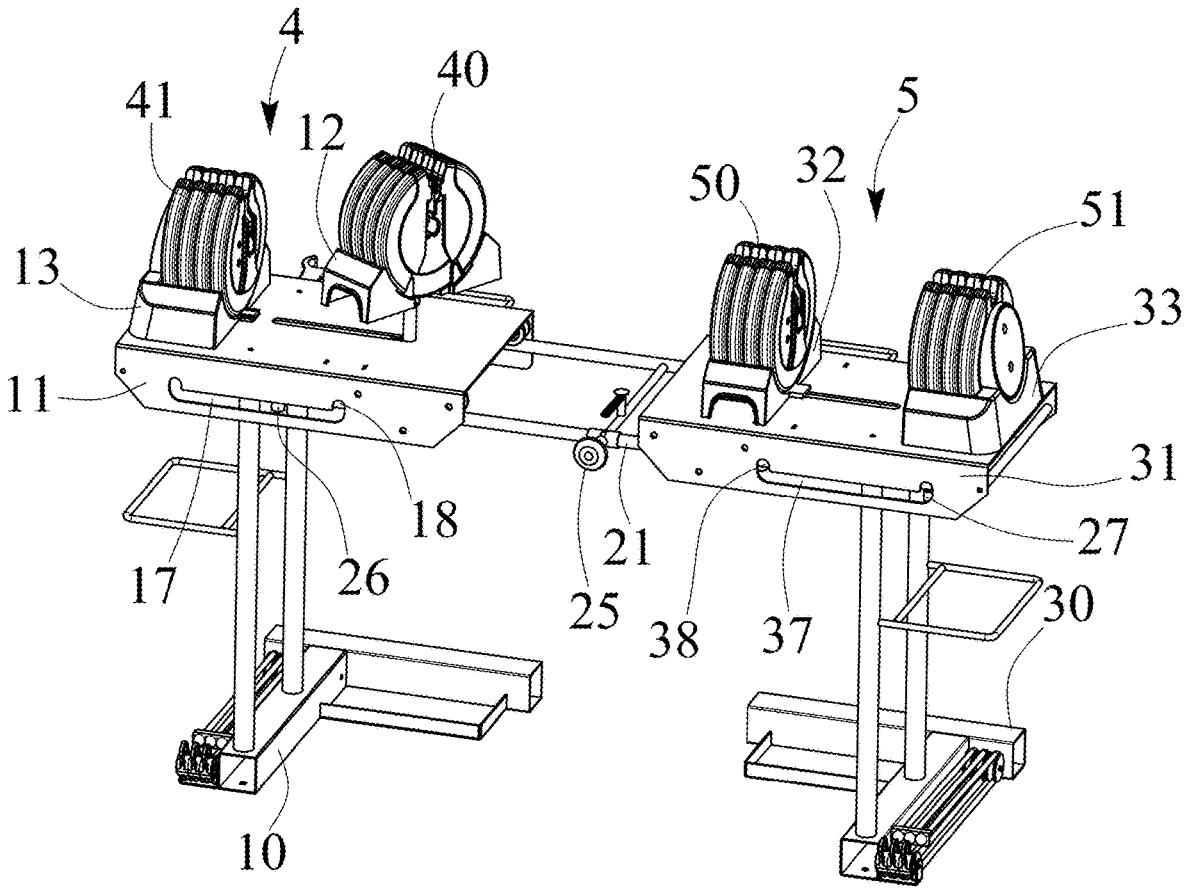
Figure 11:
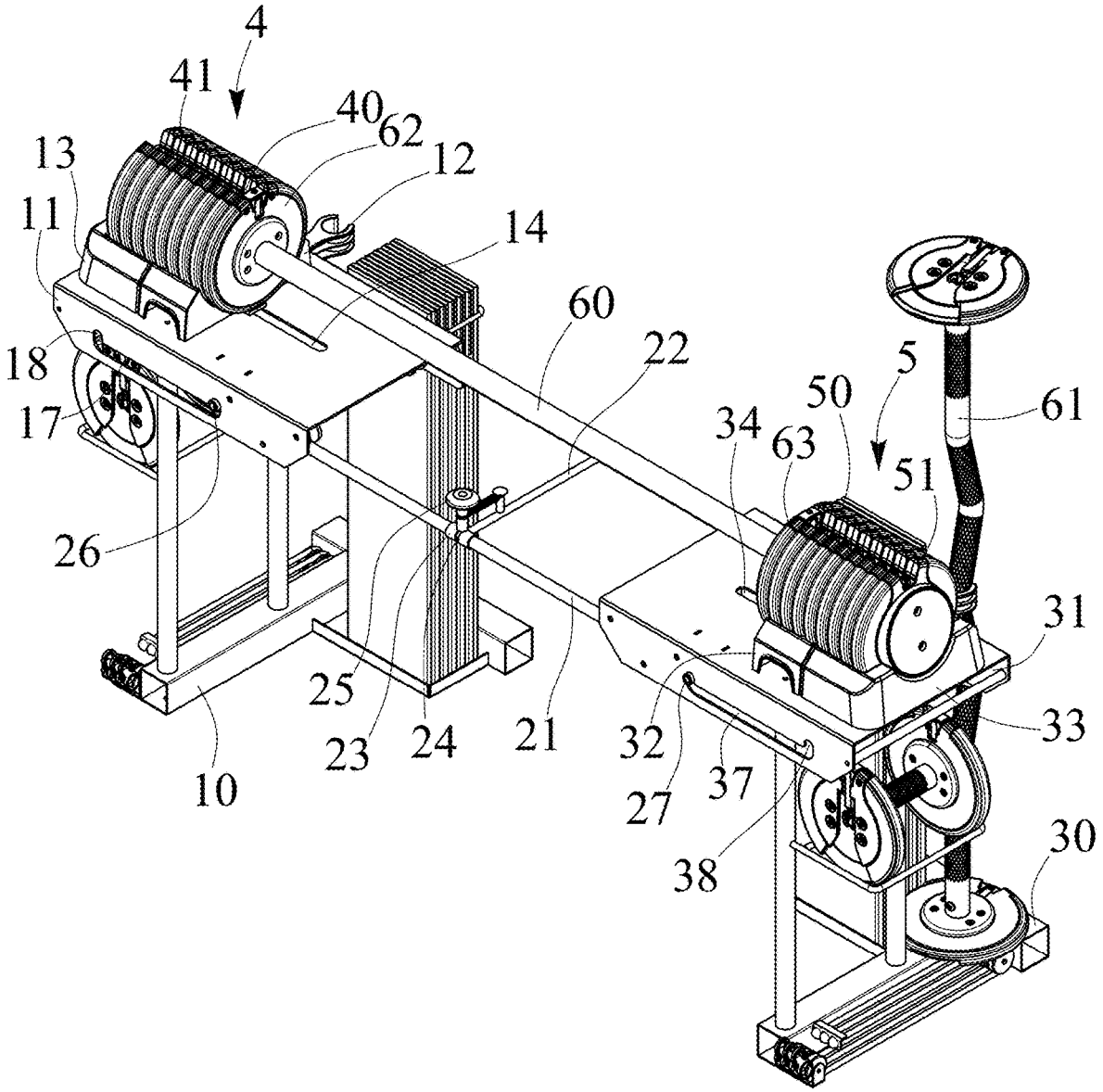

When it is required to be acted or operated as a barbell exerciser, as shown in FIGS. 7-11, the knob 25 may pivot or rotate the rod 21 relative to the tables 10, 30 to disengaged the studs 26, 27 of the rod 21 from the notches 18, 38 of the plates 11, 31 or of the tables 10, 30 and for allowing the tables 10, 30 to be slid and moved away from each other, and the studs 26, 27 may be engaged with the other notches 18, 38 of the plates 11, 31 or of the tables 10, 30 for anchoring or retaining or locking or positioning the tables 10, 30 at the second position where the tables 10, 30 are located farther away from each other (FIGS. 9 and 11). When the tables 10, 30 are moved away from each other, the brackets 12, 32 may be slid and moved relative to and toward the plates 11, 31 of the tables 10, 30 and may also be pivoted or rotated relative to the tables 10, 30 and the other weight members 41 and the weight elements 51 for about one hundred and eighty (180) degrees and thus for allowing the weight members 40, 41 and the weight elements 50, 51 to be moved close to each other or to be disposed beside each other and engaged with each other.

One or more longitudinal bars 60, 61 each include two end plates or panels 62, 63 (FIGS. 1-2, 5-6 and 11) for engaging with the weight members 40 and the weight elements 50 of the dumbbells 4, 5 respectively, and for allowing the weight members 40, 41 and the weight elements 50, 51 to be attached or coupled to the longitudinal bars 60, 61 respectively, and to be acted as a barbell device.

Accordingly, the dumbbell and barbell supporting system in accordance with the present invention includes an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dumbbell and barbell supporting system comprising:

a first table including a first plate, a first casing disposed on said first plate, a first bracket disposed on said first plate and slidable toward and away from said first casing, and rotatable relative to said first plate and said first casing and said first table, a second table including a second plate, said second table being movable toward and away from said first table, a second casing disposed on said second plate, a second bracket disposed on said second plate and slidable toward and away from said second casing, and rotatable relative to said second plate and said second casing and said second table, a first dumbbell disposed on said first table, said first dumbbell including a first weight member disposed on said first bracket, and a second weight member disposed on said first casing, and a first handlebar engageable with said first weight member and said second weight member for detachably coupling said first weight member and said second weight member to said first handlebar, a second dumbbell disposed on said second table, said second dumbbell including a first weight element disposed on said second bracket, and a second weight element disposed on said second casing, and a second handlebar engageable with said first weight element and said second weight element for detachably coupling said first weight element and said second weight element to said second handlebar, said first weight member and said first bracket being movable toward and rotatable relative to said second weight member and said first casing, and being disposed beside said second weight member when said first weight member and said first bracket are moved toward said second weight member and said first casing and rotated relative to said second weight member and said first casing, said first weight element and said second bracket being movable toward and rotatable relative to said second weight element and said second casing, and being disposed beside said second weight element when said first weight element and said second bracket are moved toward said second weight element and said second casing and rotated relative to said second weight element and said second casing, and a longitudinal bar engageable with said first weight member and said first weight element for detachably coupling said first weight member and said second weight member and said first weight element and said second weight element to said longitudinal bar.

2. The dumbbell and barbell supporting system as claimed in claim 1, wherein said first and said second tables each include a groove formed in said first and said second plates, and said first and said second brackets each include a pivot spindle engaged with said groove of said first and said second plate for guiding and limiting said first and said second brackets to slide and move and to rotate relative to said first and said second plates.

3. The dumbbell and barbell supporting system as claimed in claim 1, wherein a first rod is engaged between said first and said second tables for guiding and limiting said first and said second tables to slide and move relative to each other.

4. The dumbbell and barbell supporting system as claimed in claim 3, wherein said first and said second tables each include at least one roller engaged with said first rod for guiding said first rod to slide and move relative to said first and said second tables.

5. The dumbbell and barbell supporting system as claimed in claim 3, wherein said first and said second tables each include a channel formed in said first and said second plates, and said first rod includes two studs engaged in said channels of said first and said second plates for guiding and limiting said first and said second tables to slide and move relative to each other.

6. The dumbbell and barbell supporting system as claimed in claim 5, wherein said first and said second tables each include a notch formed in said first and said second plates and communicating with said channels of said first and said second plates respectively for engaging with said studs.

7. The dumbbell and barbell supporting system as claimed in claim 6, wherein said first rod includes a knob for rotating said first rod relative to said first and said second tables and for disengaging and engaging said studs with said notches of said first and said second plates.

8. The dumbbell and barbell supporting system as claimed in claim 7, wherein a second rod is engaged between said first and said second tables for guiding and limiting said first and said second tables to slide and move relative to each other.

9. The dumbbell and barbell supporting system as claimed in claim 8, wherein said first and said second tables each include at least one roller engaged with said second rod for guiding said second rod to slide and move relative to said first and said second tables.

10. The dumbbell and barbell supporting system as claimed in claim 8, wherein said second rod includes a tube coupled to said first rod.

11. The dumbbell and barbell supporting system as claimed in claim 10, wherein said tube includes a barrel for receiving and engaging with said first rod.

12. The dumbbell and barbell supporting system as claimed in claim 11, wherein said barrel includes a slot, and said knob is engaged in said slot of said barrel for limiting and guiding said first rod to rotate relative to said barrel.

* * * * *